US009277631B2

(12) United States Patent
Dobler

(10) Patent No.: US 9,277,631 B2
(45) Date of Patent: Mar. 1, 2016

(54) LIGHTING APPARATUS HAVING A LIGHTING MEANS COMPRISING AT LEAST ONE LED

(71) Applicant: Diehl Aerospace GmbH, Überlingen (DE)

(72) Inventor: Stefan Dobler, Neunkirchen am Brand (DE)

(73) Assignee: Diehl Aerospace GmbH, Uberlingen (DE)

( * ) Notice: Subject to any disclaimer, the term of this patent is extended or adjusted under 35 U.S.C. 154(b) by 259 days.

(21) Appl. No.: 13/904,364

(22) Filed: May 29, 2013

(65) Prior Publication Data

US 2013/0320874 A1 Dec. 5, 2013

(30) Foreign Application Priority Data

Jun. 2, 2012 (DE) ..... 10 2012 011 049

(51) Int. Cl.
*H05B 37/02* (2006.01)
*H05B 33/08* (2006.01)

(52) U.S. Cl.
CPC ..... *H05B 37/0272* (2013.01); *H05B 33/0854* (2013.01)

(58) Field of Classification Search
None
See application file for complete search history.

(56) References Cited

U.S. PATENT DOCUMENTS

| | | | | |
|---|---|---|---|---|
| 6,586,890 | B2 | 7/2003 | Min et al. | |
| 2010/0001648 | A1* | 1/2010 | De Clercq et al. | 315/113 |
| 2010/0231132 | A1* | 9/2010 | Logiudice et al. | 315/161 |
| 2011/0069094 | A1* | 3/2011 | Knapp | 345/690 |
| 2012/0025740 | A1 | 2/2012 | Schenk et al. | |

FOREIGN PATENT DOCUMENTS

| | | | |
|---|---|---|---|
| DE | 10 2004 061 294 | A1 | 6/2006 |
| DE | 10 2010 020 960 | A1 | 11/2011 |
| WO | 2011/139548 | A2 | 11/2011 |

* cited by examiner

*Primary Examiner* — Cassandra Cox
(74) *Attorney, Agent, or Firm* — Scully Scott Murphy and Presser

(57) ABSTRACT

A lighting apparatus is provided. A lighting means of the apparatus has one or more LEDs. A first device of the apparatus cooperates with a pulse width modulation device for optionally adjusting brightness of the LED. To simplify the maintenance of the lighting apparatus, a memory and a second device are provided. The memory stores information relating to the lighting means. The second device generates a signal, which encodes the information using the pulse width modulation device. As a result, the signal can be transmitted by the LEDs as a pulse width-modulated light signal.

36 Claims, 2 Drawing Sheets

LIGHTING APPARATUS HAVING A LIGHTING MEANS COMPRISING AT LEAST ONE LED

BACKGROUND OF THE INVENTION

The invention relates to a lighting apparatus having a lighting means comprising at least one LED and having a first device co-operating with a pulse width modulation device for optionally adjusting a brightness of the LED, wherein a memory for storing at least one piece of information relating to the lighting means and a second device for generating a signal which encodes the information using the pulse width modulation device are provided so that the signal can be transmitted by means of the LED as a pulse width-modulated light signal (L).

DISCUSSION OF THE PRIOR ART

Such a lighting apparatus is, for example, known from U.S. Pat. No. 6,586,890 B2.

Recently, lighting apparatuses having light-emitting diodes or LEDs as lighting means have been increasingly used for illuminating cabins in passenger aircraft. LEDs are characterized by low energy consumption and longevity. Nevertheless, such lighting apparatuses must also be maintained and replaced when a specified operational lifetime has been reached. For this purpose, connecting a controller which is provided in the lighting apparatuses for exchanging data with a central control computer is already known particularly in passenger aircraft. Maintenance-related information about the individual lighting apparatuses can be read out by means of an interface which is provided on the control computer. Providing such a control computer and an electrical bus system to be provided for connecting to the lighting apparatuses along with software for reading out the information is relatively expensive. Such an expense is not economically justifiable, particularly when manufacturing smaller passenger aircraft for short-haul operations.

SUMMARY OF THE INVENTION

The object of the invention is to eliminate the disadvantages according to the prior art. In particular, a lighting apparatus should be specified which is extremely simple to manufacture and which enables reading out maintenance-related information.

In accordance with the invention, it is proposed that a memory for storing at least one piece of information relating to the lighting means and a second device for generating a signal which encodes the information using the pulse-width modulation device are provided so that the signal can be transmitted by means of the LED as a pulse width-modulated light signal.

According to the invention, a pulse width modulation device which is provided in the lighting apparatus in any case for adjusting the brightness of the at least one LED is advantageously used to transmit a pulse width-modulated light signal which encodes maintenance-related information, by means of the LED which is provided in the lighting apparatus in any case. The hardware of a conventional lighting apparatus hardly has to be changed or supplemented in order to provide this additional function. The proposed additional function of generating a signal which encodes the information, as well as its transmission as a pulse width-modulated light signal via the LED, can essentially be provided by means of a suitable software application. On the hardware side, the provision of an additional memory for storing the information relating to the lighting means or a device for measuring an operational lifetime of the lighting means may possibly be required. If they are not already present, additional hardware components of this kind are easily available at a low price.

Thus, according to the invention, no central control computer having an interface and bus system for connecting to the lighting apparatuses and the like is necessary for transmitting maintenance-related information. The maintenance-related information is transmitted wirelessly as a pulse width-modulated light signal and can be received by means of a suitable receiver. The proposed lighting apparatus can thus be manufactured in a simple and economical manner. It is particularly suited for use in smaller passenger aircraft.

According to one advantageous embodiment, the LED is a white LED. The lighting apparatus generally comprises a plurality of white LEDs. All LEDs in the lighting apparatus do not have to be used to transmit the pulse width-modulated light signal. The use of merely one LED or a specified subset of the LEDs is sufficient.

The information is expediently a code which enables an identification of manufacturer-related data about the lighting means or the lighting apparatus. The code may be, for example, a serial number, information about the manufacturer and/or a manufacturing date.

The information is expediently a measurement or count value preferably describing an operational lifetime of the lighting means. Thus, a remaining lifetime of the lighting means can be quickly and easily ascertained. It is possible to estimate when the lighting apparatus or the lighting means must be replaced. This improves the maintenance efficiency, particularly in passenger aircraft.

According to another embodiment of the invention, a switching device for optionally and preferably alternately switching on the first or second device is provided. The switching apparatus may, for example, comprise a switch or pushbutton which, when actuated, causes the first device to be switched off and the second device to be simultaneously switched on, and the information to be automatically transmitted as a pulse width-modulated light signal. However, it may also be the case that the switching apparatus is adapted to decode a signal transmitted via an electrical network and to switch on either the first or the second device as a function of the signal. Finally, the switching apparatus may also comprise a receiver for receiving data wirelessly. For example, the switching apparatus may comprise a Bluetooth or IR interface or the like. This makes it possible, for example, to transmit a switching signal to the switching apparatus by means of a mobile transceiver, so that the second device is switched on and the pulse width-modulated light signal encoding the information is then transmitted. It is possible to receive and decode the signal by means of the transceiver.

According to another advantageous embodiment, when the lighting apparatus is switched on by means of the switching apparatus, the second device is automatically switched on initially for a specified minimum period. In other words, after the lighting apparatus is switched on, the pulse width-modulated light signal encoding the information is automatically transmitted initially for a specified minimum period. The pulse width modulation device is expediently operated at a pulse width modulation frequency of at least 300 Hz, but preferably more than 300 Hz. In such a case, the human eye cannot perceive that information is being transmitted as a light signal by means of the LED. In this case, it appears to the human eye that the LED is merely producing white light.

According to an especially advantageous embodiment, a receiver with a downstream evaluation circuit for decoding the additional signal is provided in the lighting apparatus for receiving another signal. The provision of the proposed receiver enables bidirectional communication. The additional signal may, for example, be an IR, Bluetooth or radio signal. The additional signal is advantageously an additional pulse width-modulated light signal. In this case, the receiver comprises a photodiode for detecting the additional light signal. For example, a software application for operating the first and/or second device can be encoded with the additional signal. It is thus possible, for example, to transmit software updates and install them on the lighting apparatus for operating the first and/or second device. The provision of the proposed receiver is also not especially expensive. It is thus nonetheless possible not only to read out maintenance-related data from the lighting apparatus, but also to repair, adjust, or update it via a new installation or an update of the software required for operating the lighting apparatus.

According to a further provision of the invention, a lighting apparatus, in particular, for an aircraft, is proposed having a central controller for transmitting control signals to the first devices of a plurality of the lighting apparatuses according to the invention. In other words, the lighting apparatuses according to the invention may also be connected to a central controller, for example, a central computer, for the purpose of exchanging data or signals. Thus, the brightness of the lighting apparatus can be adjusted or modified, for example, according to a specified program. It is of course also possible to switch the first and/or the second device on or off with the central controller. An electrical bus system can be provided for transmitting the control signals. However, it may also be the case that the control signals are transmitted by means of a suitable device via power supply lines for supplying the lighting apparatuses with electricity.

According to another embodiment of the invention, a device for maintaining a lighting means according to the invention is proposed, comprising a mobile receiver having an additional photodiode and an additional downstream evaluation circuit for decoding the light signal. The mobile receiver may also have a device for transmitting the additional signal. In other words, the mobile receiver can transmit additional signals, preferably pulse width-modulated light signals, to a receiver which is provided in the lighting apparatus. It is, for example, possible to use such additional signals to switch the second device on or off. Furthermore, it is possible to transmit software updates or the like to the lighting apparatus. The mobile receiver expediently comprises a display and a storage apparatus for storing the information received from the lighting apparatus. The received information can be shown immediately on the display. It is thus possible to decide whether maintenance of the lighting apparatus is required.

The mobile receiver may, for example, be a conventional smartphone which is coupled, via an interface which is provided on it, to the additional photodiode and the additional downstream evaluation circuit for decoding the light signal. The information which is thus downloaded can be immediately transmitted to a maintenance centre. This makes it possible to draw up maintenance schemes which are particularly efficient.

BRIEF DESCRIPTION OF THE DRAWINGS

An embodiment of the invention is described in detail below by means of the drawings. The following are shown.

DETAILED DESCRIPTION OF THE INVENTION

Figure 1:
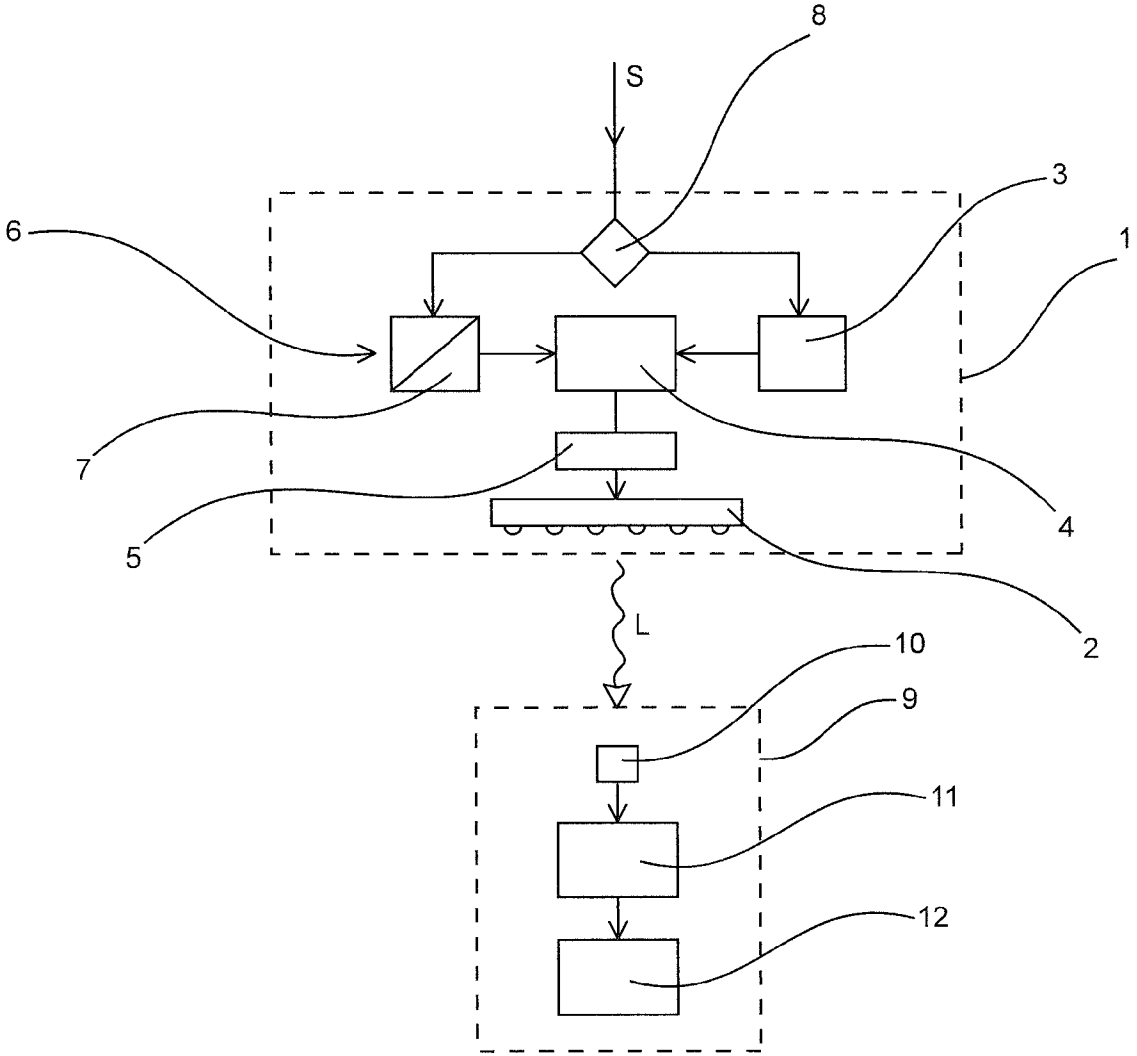
FIG. 1 A schematic block diagram of a first apparatus.

In FIG. 1, a lighting apparatus 1 comprises a lighting means 2. It may be a plurality of white LEDs accommodated on a printed circuit board. A first device 3 can be coupled to a pulse width modulation device 4. A power supply device, which is designated by the reference number 5, supplies the lighting means 2 with power as a function of the pulses supplied by the pulse width modulation device 4.

A second device, which is designated by the reference number 6, is provided with a first memory 7. The second device 6 can likewise be coupled to the pulse width modulation device 4.

The first device 3 or the second device 6 can be switched on alternately by means of a switching apparatus 8.

A mobile receiver, which is designated by the reference number 9, has a first photodiode 10, a downstream first evaluation circuit 11 and a display 12.

The function of the first apparatus is as follows:

In a first operating state, the first device 3 is switched on and the second device 6 is switched off by means of the switching apparatus 8. The pulse width modulation device 4 is activated by means of the first device 3 as a function of control signals supplied via a control line S such that the lighting means 2 generate a specified brightness. The brightness can be varied as a function of the control signals.

In a second operating state, the first device 3 is switched off and the second device 6 is switched on by means of the switching apparatus 8. Information is stored in the first memory 7 which, for example, enables identification of the lighting apparatus 1. In the second operating state, the information is encoded by means of the second device 6 and converted by means of the pulse width modulation device 4 into a light signal L which is transmitted using the lighting means 2. The light signal L can be transmitted, for example, at a frequency from 300 to 1000 Hz. It is not recognizable by the human eye as a signal. The human eye perceives the light signal L as white light.

The light signal L is received by the first photodiode 10 of the mobile receiver 9. The light signal L is decoded by means of a downstream first evaluation circuit 11. Information corresponding to the light signal L can subsequently be shown on the display 12.

Figure 2:
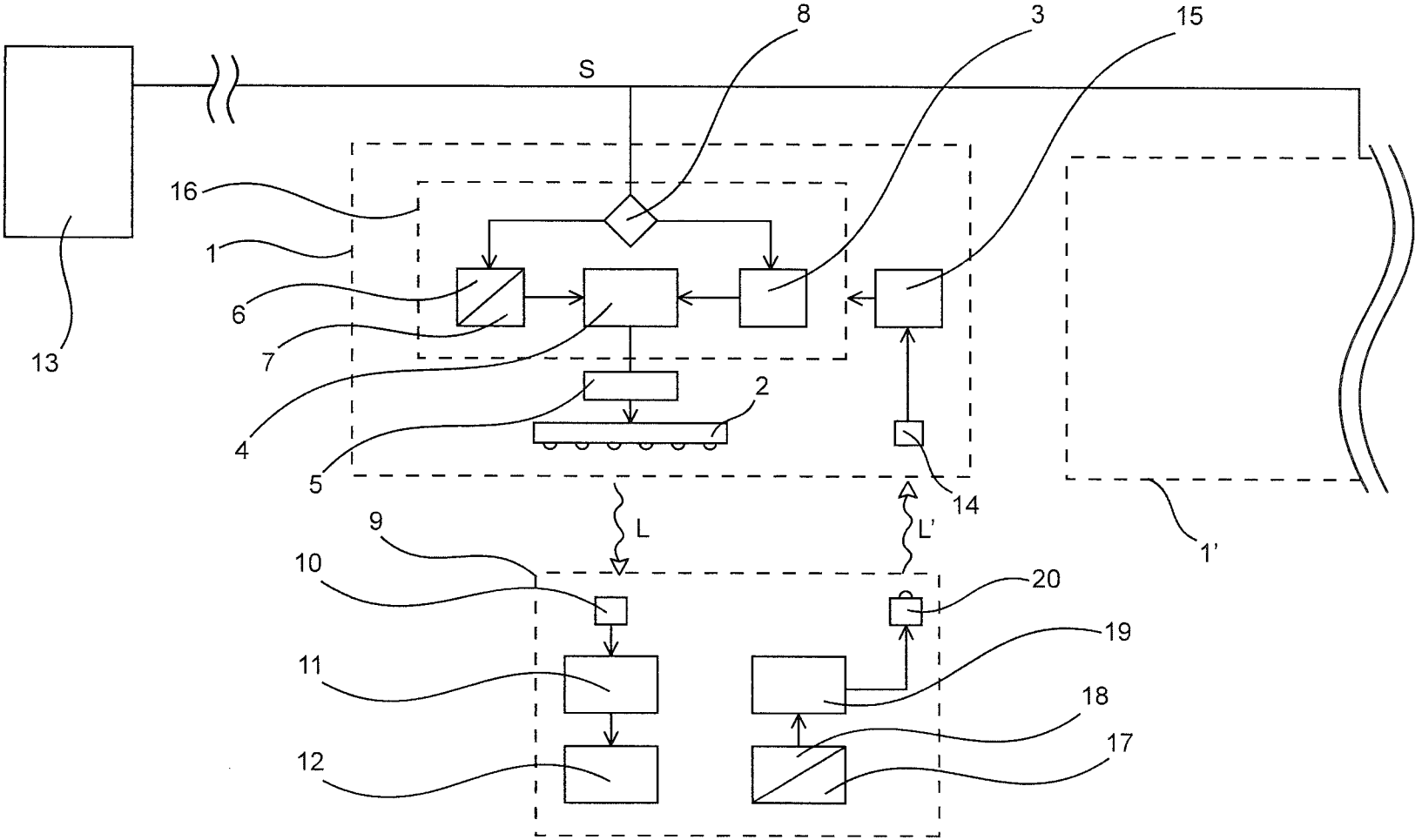
FIG. 2 A schematic block diagram of a second apparatus.

FIG. 2 shows a schematic block diagram of a second apparatus. A plurality of lighting apparatuses 1, 1' is connected to a central controller 13 via the control line S. The central controller 13 may be a computer with which, for example, functions are controlled in the cabin of a passenger aircraft. Here, the lighting apparatus 1 also comprises a second photodiode 14 having a downstream second evaluation circuit 15. In order to exchange data, the second evaluation circuit 15 is connected to a control unit 16 comprising the first device 3, the pulse width modulation device 4, the second device 6 and the switching apparatus 8.

The first device 3, the second device 6, the third device 17 if applicable, the pulse width modulation device 4 and/or the switching apparatus 8 may be combined in a conventional programmable process computer controller. As a result, the first device 3, the second device 6, the third device 17 if applicable, as well as the switching apparatus 8 and the second evaluation circuit 15 if applicable, may involve functional sections of a software application for operating the process computer controller.

Here, the mobile receiver 9 also comprises a transmitting unit. The transmitting unit comprises the third device 17 having a second memory 18, an additional downstream pulse width modulation device 19, an additional power supply device (not shown here) and an additional LED 20.

The additional functions of the second apparatus are as follows:

In the second apparatus, control signals for adjusting the brightness and/or switching signals can be transmitted from the central controller 13 via the control line S to the switching apparatus 8 and the first device 3. As a result, activating the first device 3 makes it possible to control the brightness of the lighting means 2 by means of the central controller 13.

By means of the embodiment of the mobile receiver 9 shown in FIG. 2, it is possible, for example, to store a software update for the operation of the control unit 16 of the lighting apparatus 1 in the second memory 18. By means of the third device 17, it is possible to encode the data corresponding to the software application and to turn it into an additional light signal L', which is transmitted by means of the second LED 20, by means of the additional pulse width modulation device 19 and an additional power supply device (not shown here). The additional light signal L' is received by the second photodiode 14 and decoded by means of the downstream second evaluation circuit 15. The exemplary decoded software update can then be fed to the control unit 16. The proposed bidirectional data transmission by means of light signals L and additional light signals L° makes it possible to perform comprehensive maintenance and/or repair and updates of the lighting apparatus 1 quickly and easily.

LIST OF REFERENCE NUMBERS

1 Lighting apparatus
1' Additional lighting apparatus
2 Lighting means
3 First device
4 Pulse width modulation device
5 Power supply device
6 Second device
7 First memory
8 Switching apparatus
9 Mobile receiver
10 First photodiode
11 First evaluation circuit
12 Display
13 Central controller
14 Second photodiode
15 Second evaluation circuit
16 Control unit
17 Third device
18 Second memory
19 Additional pulse width modulation device
20 Additional LED
L Light signal
L' Additional light signal
S Control line

What is claimed is:

1. A lighting apparatus comprising:
a lighting means comprising at least one LED;
a first device co-operating with a pulse width modulation device for selectively adjusting a brightness of the LED;
a memory for storing at least one piece of information relating to the lighting means; and
a second device for generating a signal which encodes the information using the pulse width modulation device, such that the signal can be transmitted by means of the LED as a pulse width-modulated light signal,
wherein the information comprises a measurement value describing an operational lifetime of the lighting means.

2. The lighting apparatus according to claim 1, wherein the LED comprises a white LED.

3. The lighting apparatus according to claim 1, wherein the information comprises a code which enables an identification of manufacturer-related data of the lighting means.

4. The lighting apparatus according to claim 1, further comprising a switching apparatus for selectively switching on the first device or the second device.

5. The lighting apparatus according to claim 4, wherein when the lighting apparatus is switched on by the switching apparatus, the second device is automatically switched on initially for a predetermined minimal period.

6. The lighting apparatus according to claim 1, further comprising:
a receiver for receiving an additional light signal, wherein the receiver comprises a photodiode; and
a downstream evaluation circuit for decoding the additional light signal.

7. The lighting apparatus according to claim 6, wherein the additional light signal encodes software for operating at least one of the first device and the second device.

8. A lighting apparatus used in connection with a plurality of lighting apparatuses each according to claim 1, comprising a central controller for transmitting control signals to the first devices of said plurality of lighting apparatuses.

9. The lighting apparatus according to claim 8, wherein said lighting apparatus is in an aircraft.

10. A device for maintaining a lighting apparatus according to claim 1, comprising a mobile receiver, wherein the mobile receiver comprises an additional photodiode and an additional downstream evaluation circuit for decoding the light signal.

11. The device according to claim 10, wherein the mobile receiver comprises a transmitting device for transmitting an additional signal.

12. The device according to claim 11, wherein said additional signal comprises an additional pulse width-modulated light signal.

13. A lighting apparatus comprising:
a lighting means comprising at least one LED;
a first device co-operating with a pulse width modulation device for selectively adjusting a brightness of the LED;
a memory for storing at least one piece of information relating to the lighting means;
a second device for generating a signal which encodes the information using the pulse width modulation device, such that the signal can be transmitted by means of the LED as a pulse width-modulated light signal; and
a switching apparatus for selectively switching on the first device or the second device.

14. The lighting apparatus according to claim 13, wherein the LED comprises a white LED.

15. The lighting apparatus according to claim 13, wherein the information comprises a code which enables an identification of manufacturer-related data of the lighting means.

16. The lighting apparatus according to claim 13, wherein the information comprises a measurement value describing an operational lifetime of the lighting means.

17. The lighting apparatus according to claim 13, wherein when the lighting apparatus is switched on by the switching apparatus, the second device is automatically switched on initially for a predetermined minimal period.

18. The lighting apparatus according to claim 13, further comprising:

a receiver for receiving an additional light signal, wherein the receiver comprises a photodiode; and a downstream evaluation circuit for decoding the additional light signal.

19. The lighting apparatus according to claim 18, wherein the additional light signal encodes software for operating at least one of the first device and the second device.

20. A lighting apparatus used in connection with a plurality of lighting apparatuses each according to claim 13, comprising a central controller for transmitting control signals to the first devices of said plurality of lighting apparatuses.

21. The lighting apparatus according to claim 20, wherein said lighting apparatus is in an aircraft.

22. A device for maintaining a lighting apparatus according to claim 13, comprising a mobile receiver, wherein the mobile receiver comprises an additional photodiode and an additional downstream evaluation circuit for decoding the light signal.

23. The device according to claim 22, wherein the mobile receiver comprises a transmitting device for transmitting an additional signal.

24. The device according to claim 23, wherein said additional signal comprises an additional pulse width-modulated light signal.

25. A lighting apparatus comprising:

a lighting means comprising at least one LED;

a first device co-operating with a pulse width modulation device for selectively adjusting a brightness of the LED;

a memory for storing at least one piece of information relating to the lighting means;

a second device for generating a signal which encodes the information using the pulse width modulation device, such that the signal can be transmitted by means of the LED as a pulse width-modulated light signal;

a receiver for receiving an additional light signal, wherein the receiver comprises a photodiode; and a downstream evaluation circuit for decoding the additional light signal.

26. The lighting apparatus according to claim 25, wherein the LED comprises a white LED.

27. The lighting apparatus according to claim 25, wherein the information comprises a code which enables an identification of manufacturer-related data of the lighting means.

28. The lighting apparatus according to claim 25, wherein the information comprises a measurement value describing an operational lifetime of the lighting means.

29. The lighting apparatus according to claim 25, further comprising a switching apparatus for selectively switching on the first device or the second device.

30. The lighting apparatus according to claim 29, wherein when the lighting apparatus is switched on by the switching apparatus, the second device is automatically switched on initially for a predetermined minimal period.

31. The lighting apparatus according to claim 25, wherein the additional light signal encodes software for operating at least one of the first device and the second device.

32. A lighting apparatus used in connection with a plurality of lighting apparatuses each according to claim 25, comprising a central controller for transmitting control signals to the first devices of said plurality of lighting apparatuses.

33. The lighting apparatus according to claim 32, wherein said lighting apparatus is in an aircraft.

34. A device for maintaining a lighting apparatus according to claim 25, comprising a mobile receiver, wherein the mobile receiver comprises an additional photodiode and an additional downstream evaluation circuit for decoding the light signal.

35. The device according to claim 34, wherein the mobile receiver comprises a transmitting device for transmitting the additional signal.

36. The device according to claim 35, wherein said additional signal comprises an additional pulse width-modulated light signal.

* * * * *